US006409164B1

(12) United States Patent
Klopfenstein et al.

(10) Patent No.: US 6,409,164 B1
(45) Date of Patent: Jun. 25, 2002

(54) FEEDER PILE RESTRICTOR AND METHOD

(75) Inventors: Andrew Lynn Klopfenstein, Tipp City; Russell Alan Bechler, Bellbrook, both of OH (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/561,468

(22) Filed: Apr. 28, 2000

(51) Int. Cl.[7] ..... B65H 3/34

(52) U.S. Cl. ..... 271/104; 271/124; 271/165; 271/167

(58) Field of Search ..... 271/104, 106, 271/121, 124, 137, 145, 167, 169, 165

(56) References Cited

U.S. PATENT DOCUMENTS 2,251,943 A 8/1941 Kleinberg ..... 270/54
2,335,064 A * 11/1943 Kabel
4,364,549 A * 12/1982 Komossa et al.
4,456,241 A * 6/1984 Newsome
5,330,171 A * 7/1994 Murad et al.
5,447,302 A 9/1995 Curley ..... 271/277

* cited by examiner

*Primary Examiner*—H. Grant Skaggs
(74) *Attorney, Agent, or Firm*—Davidson, Davidson & Kappel, LLC

(57) ABSTRACT

A pile restrictor includes a restrictor body and a restricting blade attached to the body, the restricting blade being adjustable angularly with respect to the body during an operating mode of a sheet feeder. The present invention also provides a pile feed device having a front guide and at least one pile restrictors, each of the pile restrictors connected to the front guide and including a body and a restricting blade attached to the body, the blade being adjustable angularly with respect to the body during the operating mode. Also disclosed is a method of restricting a sheet pile comprising the steps of placing a pile of sheets in a feeder so that the nose of the pile is restricted by a restrictor; and adjusting an angle of the restrictor furing operation of the feeder.

13 Claims, 3 Drawing Sheets

FEEDER PILE RESTRICTOR AND METHOD

BACKGROUND OF THE INVENTION

1. Field of the Invention

The present invention relates generally to printed product collation and more particularly to a device and method for providing sheets in a stack to a conveyance device.

2. Background Information

U.S. Pat. No. 5,447,302 ("the '302 patent") discloses an apparatus for removing paper products from a stack on a feeder, also known as a hopper. The apparatus has a rotatably mounted gripper drum which takes the bottom sheet or signature from a stack or pile of sheets. FIG. 3 of the '302 patent shows a sheet of signatures stacked for removal by the gripper drum. A part of the sheets rests on a platform, so that a nose of the stack protrudes over the end of the platform and is restricted by a pile restrictor.

Restrictors maintain the position of the nose of the pile, prohibiting the pile from bending down over the edge of the platform. Restrictors also help prevent the second sheet or signature from being vacuumed down along with the sheet to be transferred to the gripping device.

The restrictor of the '302 patent may inadvertently permit more than one sheet to be pulled into the gripper area, thus leading to malfunction, sheet damage, or hopper blockages. Moreover, the pile restrictor of the '302 device may not permit adequate adjustment, which may for example be advantageous when different types of papers or other stacked products are to be transferred to a gripper drum. The '302 patent is hereby incorporated by reference herein.

U.S. Pat. No. 2,251,943 discloses a signature gathering machine, the signatures being stacked against an abutment or wall, as shown in FIG. 2, which suffers from the same problems described with respect to the pile restrictor of the '302 patent.

BRIEF SUMMARY OF THE INVENTION

An object of the present invention is to provide a pile restrictor which permits easy adjustment of a restrictor. An additional or alternate objective is to provide a reliable and effective restrictor and related method for restricting the pile.

The present invention provides a pile restrictor for a feeder comprising a body and a restricting blade attached to the body, the restricting blade being adjustable angularly with respect to the body while the feeder is in an operating mode.

By providing the angular adjustment, the pile restrictor of the present invention can be adjusted to provide system adjustment even while the associated hopper is running, and permits for more accurate and repeatable adjustment of the restriction function of the feed device. "Restricting blade" as defined herein need not be a blade, but can be any object used for contacting the product nose, including but not limited to a sheet-like extension, a rod, or a bar.

Preferably, the restricting blade is also adjustable along an axis of the body, so that for example a height of the pin can be set.

The pile restrictor preferably further includes a lever arm for holding the restricting blade, the restricting blade preferably being releasable from the lever arm. A spring may be provided to operate to force the blade into an open position, with the lever arm including a flat surface. An adjusting knob acting against the flat surface and threadedly supported in the body can then be used to set the angle of the restricting blade. The adjusting knob preferably is outside of a front guide of the feeder.

The pile restrictor also preferably includes a support for supporting the body and attaching the body to the front guide of the feeder. The body preferably is slidingly adjustable within the support, so that a height of the restricting blade can be adjusted. An rotatable adjustment knob threadedly supported in the body and acting against the support can adjust the position of the body with respect to the support.

The present invention also provides a pile feeder having an operating mode comprising a front guide, and at least one pile restrictor, each of the pile restrictors connected to the front guide and including a body and a restricting blade attached to the body, the restricting blade being adjustable angularly with respect to the body during the operating mode.

The pile restrictors preferably are connected in an easily replaceable fashion, i.e. by a support plate and bolts, to the front guide. The pile restrictors also preferably are adjustable along the front guide in a direction perpendicular to the height.

The present invention also provides a method of restricting a sheet pile for a feeder comprising the steps of:

placing a pile of sheets in a feed device so that the nose of the pile is restricted by a restrictor; and adjusting an angle of the restrictor while the feeder is in an operating mode.

Preferably the method further includes adjusting a height of the restrictor.

The present invention advantageously allows for tool-less height and angle adjustments and "on-the-fly" adjustments, i.e. while the hopper or feeder is still running. A releasable restricting blade can permit quick replacements, as can the releasablity of the entire restrictor.

BRIEF DESCRIPTION OF THE DRAWINGS

A preferred embodiment of the present invention is described below by reference to the following drawings, in which.

DETAILED DESCRIPTION

Figure 1:
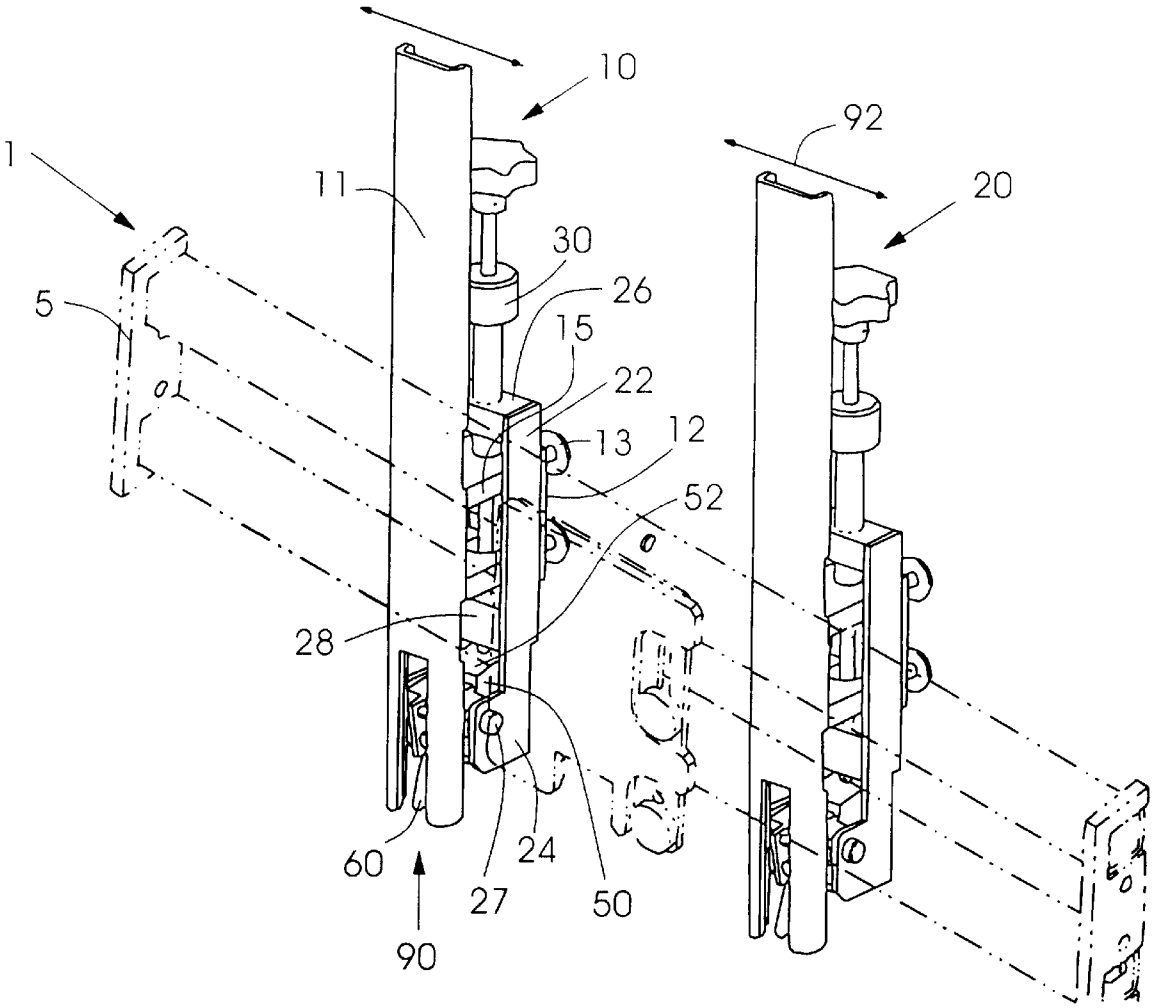
FIG. 1 shows a perspective view of a feed device with two pile restrictors according to the present invention.
Figure 2:
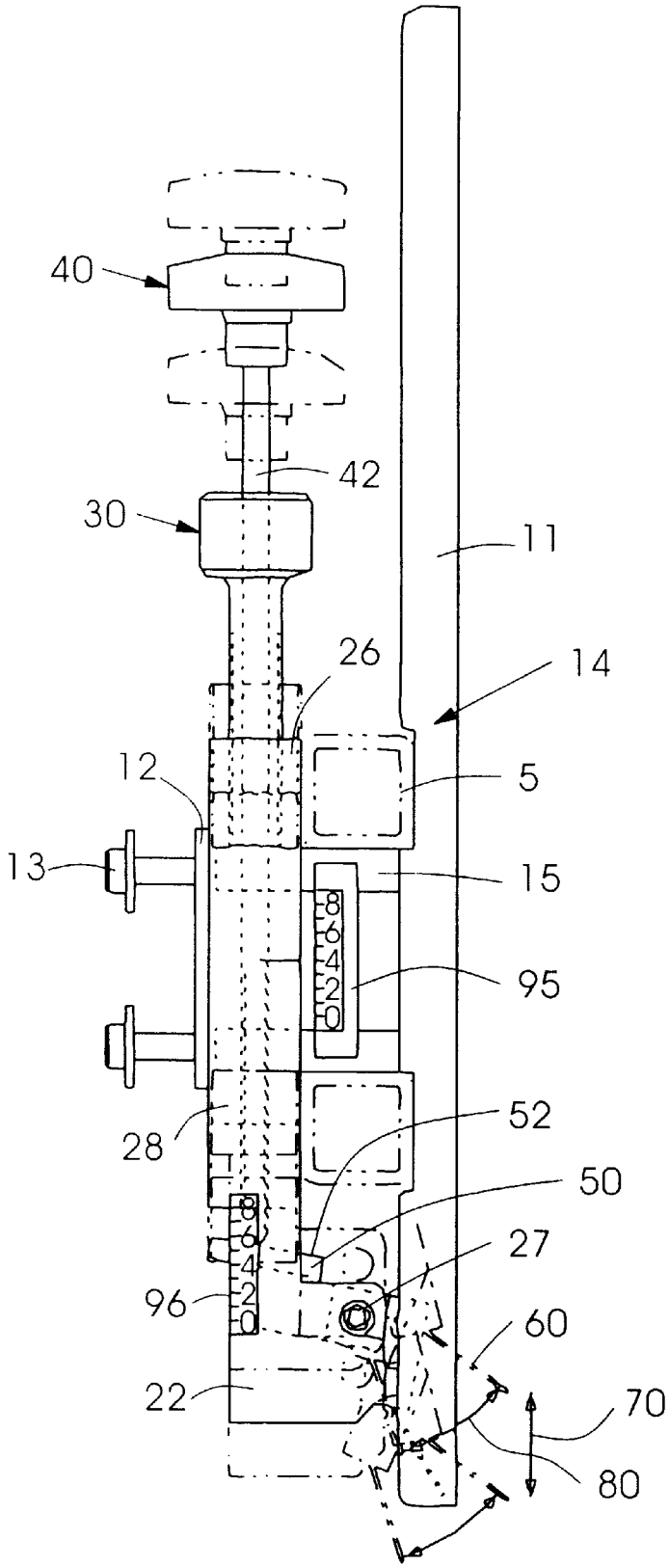
FIG. 2 shows a side view of a pile restrictor of the present invention in different positions.

FIG. 1 shows a pile feed device 1 having a front guide 5 and two pile restrictors 10 and 20. Pile restrictor 10 has a support bar 11, a support plate 12 and bolts 13 which can force support plate 12 in the direction of support bar 11 so as to tighten pile restrictor 10 about front guide 5. As shown in FIG. 2, support bar 11 may have an indentation 14 to interact with support bar 11. Bolt 13 can fit threadedly in a support arm 15 fixedly attached to support bar 11. Supported for movement with respect to the support arm 15 and support plate 12 is a restrictor body 22, which has two side walls 24 connected by an crosspiece 26 at a top end, a lower crosspiece 28, and by a pin 27 at a bottom end. Crosspiece 26 has an internally-threaded hole into which an externally-threaded height adjustment knob 30 fits. Knob 30 rests rotatably on support arm 15, so that the rotational movement of knob 30 moves restrictor body 22 up or down with respect to support arm 15 as indicated by arrow 70, due to the screw-type interaction of the threads.

Knob 30 also has an unthreaded interior hole through which fits an extension 42 of an angular adjustment knob 40. Extension 42 at a lower end has external threads which interact with interior thread of a hole in lower cross piece 28. A lower end of extension 42 contacts a flat surface 52 of a lever 50, lever 50 being rotatably supported about pin 27. Lever 50 is spring-loaded about rod 27 in a clockwise manner so as to act against extension 42. The rotation of knob 40 thus causes extension 42, through a screw-like action, to move up or down with respect to lower crosspiece 28, side wall 24 and pin 27, and thus can rotate lever 50 about pin 27 as indicated by arrow 80. Attached to lever 50 on a side opposite the flat surface 52 is a restricting blade 60.

Figure 3A:
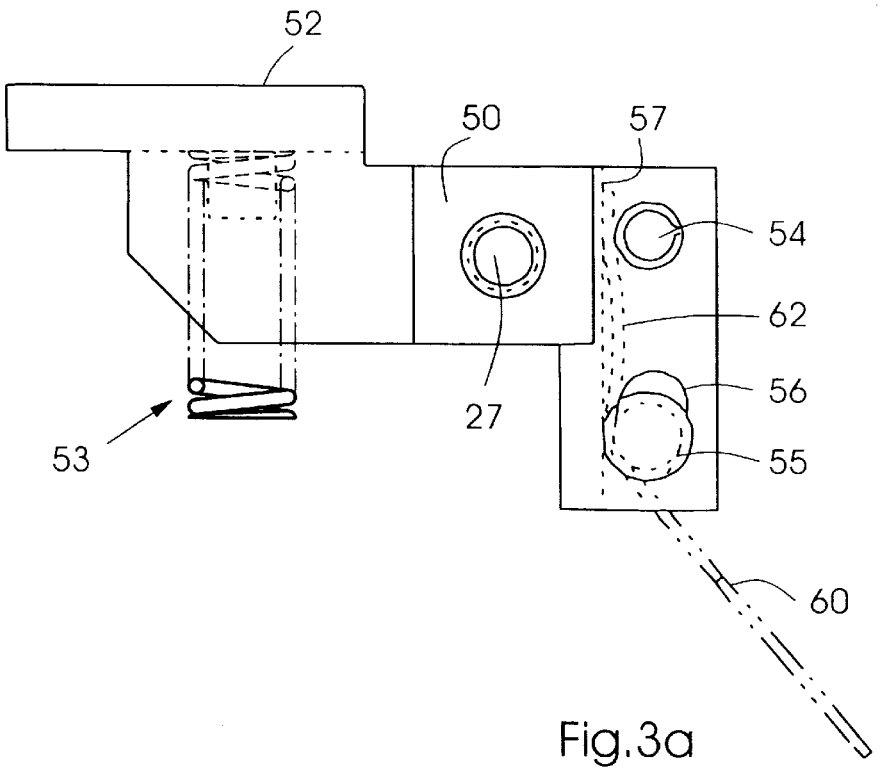
FIG. 3A shows a preferred construction of the restricting blade and lever of the present invention.

Restricting blade 60 may be made of metal, preferably spring-steel, and be of any shape as defined above, and may be integral or fixedly connected to lever 50. FIG. 3A shows a preferred embodiment of a restricting blade 60 fixedly connected to lever 50, which is spring-loaded about pin 27 by a spring 53. Restricting blade 60 has a curved support extension 62 which is held between a retaining pin 54 and a support surface 57 at one end. At the other end of extension 62, restricting blade 60 is held by a release pin 55 which fits tightly in a slot 56 of lever 50. When release pin 55 is in the position shown in FIG. 3A, the restricting blade 60 is held fixedly with respect to lever 50. Thus the rotation of lever 50 about rod 27 can cause the restricting blade 60 to move angularly with respect to restrictor body 22 and support bar 11, as indicated by arrow 80 in FIG. 2.

Restricting blade 60 can extend through a cut-out 90 in support bar 11, as shown in FIG. 1.

Figure 3B:
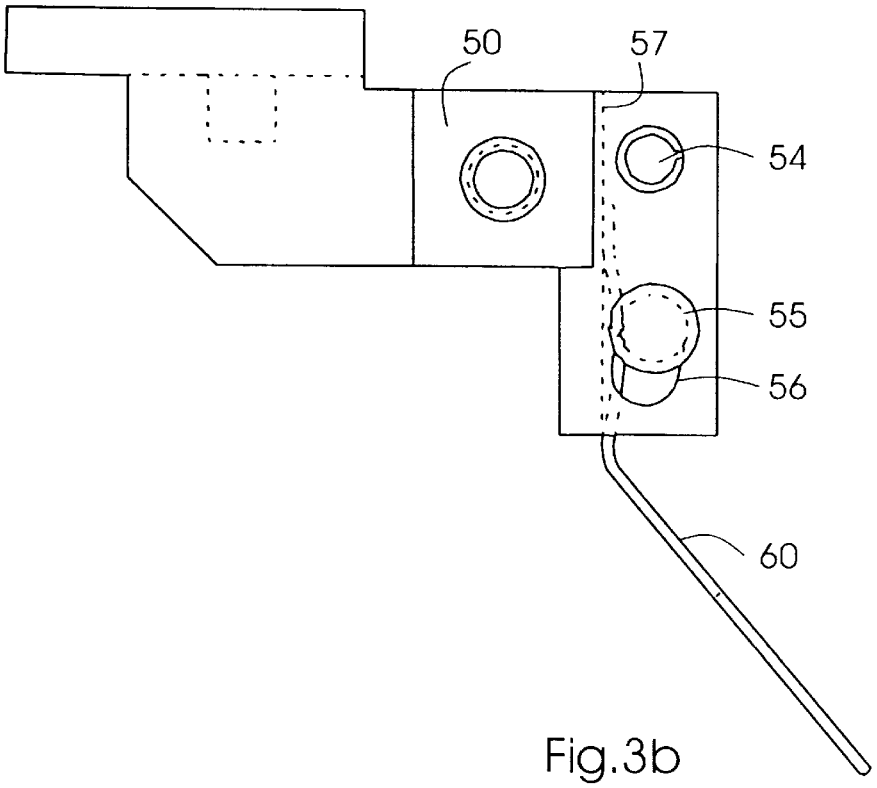
FIG. 3B shows the restricting blade of FIG. 3A being released.

Restricting blade 60 preferably is releasable for easy replacement, as shown in FIG. 3B. Release pin 55 can be moved to a release position within hole 56, so that restricting blade 60 can be slid downwardly along support surface 57 away from retaining pin 54 and removed.

The present invention thus permits for accurate height and angle adjustment of restricting blade 60 during operation of the feeder, which may be indicated by adjustment markers 95, 96.

It should be understood that restrictor 20 may be of exactly the same construction as restrictor 10, and that the restrictors 10, 20 may move along the front guide 5 as indicated by arrow 92 in FIG. 1 by loosening bolts 13. The positioning of the restrictors 10, 20 along the nose of the sheets thus may be adjusted to optimize their effect on the printed products in the pile.

What is claimed is:

1. A pile restrictor for a feeder having an operating mode, the pile restrictor comprising:

a restrictor body;

a restricting blade rotatably supported in the body so as to be adjustable angularly with respect to the body during the operating mode; and a support, the restrictor body being movably connected to the support during the operating mode so as to permit a translational movement of the restricting blade supported in the restrictor body with respect to the support.

2. The pile restrictor as recited in claim 1 wherein the restrictor body is threadedly connected to the support so that the restricting blade is adjustable along an axis of the body.

3. The pile restrictor as recited in claim 1 further comprising a lever rotatably supported in the restrictor body, the restricting blade being connected to the lever.

4. The pile restrictor as recited in claim 3 further comprising a pin supported in the restrictor body, the lever being spring-loaded about the pin.

5. The pile restrictor as recited in claim 3 further comprising an angular adjusting rod, the angular adjusting rod threadedly supported in the restrictor body and acting to rotate the lever with respect to the restrictor body.

6. The pile restrictor as recited in claim 1 wherein the restrictor body is slidingly adjustable with respect to the support.

7. The pile restrictor as recited in claim 6 further comprising a rotatable adjustment knob threadedly supported in the restrictor body for adjusting a position of the restrictor body with respect to the support.

8. The pile restrictor as recited in claim 1 wherein the restricting blade is releasably connected to the restrictor body.

9. The pile restrictor as recited in claim 1 further comprising an adjustment marker for indicating a position of the restricting blade.

10. The pile restrictor as recited in claim 1 further comprising an angular adjustment knob for setting an angular adjustment of the restricting blade, the knob being located outside of a front guide of the feeder.

11. A pile feeder having an operating mode comprising:

a front guide; and at least one pile restrictor, the at least one pile restrictor connected to the front guide and including a body and a restricting blade rotatably supported in the body so as to be adjustable angularly with respect to the body during the operating mode;

the body being movably connected to the front guide during the operating mode so as to permit a translational movement of the restricting blade supported in the restrictor body with respect to the body.

12. The pile feeder as recited in claim 11 wherein the at least one pile restrictor includes two pile restrictors.

13. A pile restrictor for a feeder having an operating mode, the pile restrictor comprising:

a restrictor body;

a restricting blade rotatably supported in the body so as to be adjustable angularly with respect to the body during the operating mode; and means for supporting the restrictor body, the restrictor body being movably connected to the support means during the operating mode so as to permit a translational movement of the restricting blade supported in the restrictor body with respect to the support means.

* * * * *